United States Patent [19]

Matsumoto et al.

[11] 3,963,487

[45] June 15, 1976

[54] ELECTROPHOTOGRAPHIC PROCESS USING SEPARATE PHOTOCONDUCTIVE ELEMENTS

[75] Inventors: Seiji Matsumoto; Isoji Takahashi, both of Asaka, Japan

[73] Assignee: Fuji Photo Film Co., Ltd., Minami-Ashigara, Japan

[22] Filed: Mar. 31, 1975

[21] Appl. No.: 563,498

Related U.S. Application Data

[63] Continuation-in-part of Ser. No. 207,810, Dec. 14, 1971, abandoned.

[30] Foreign Application Priority Data

Dec. 14, 1970 Japan ..... 45-111579

[52] U.S. Cl. ..... 96/1 R; 96/1 LY; 96/1 SD

[51] Int. Cl.[2] ..... G03G 13/04; G03G 13/06; G03G 13/22

[58] Field of Search ..... 96/1 R, 1 LY, 1 SD

[56] References Cited

UNITED STATES PATENTS

| | | | |
|---|---|---|---|
| 3,311,490 | 3/1967 | Fauser et al. | 96/1 LY X |
| 3,551,145 | 12/1970 | Trachtenberg | 96/1 R |
| 3,620,798 | 11/1971 | Honjo et al. | 96/1 SD |
| 3,888,666 | 6/1975 | Matsumoto et al. | 96/1 R |

*Primary Examiner*—Roland E. Martin, Jr.
*Attorney, Agent, or Firm*—Gerald J. Ferguson, Jr.; Joseph J. Baker

[57] ABSTRACT

An electrophotographic process comprising (1) arranging (*a*) a main photoconductive layer disposed on a conductive base, on the surface of which a charge is uniformly provided, and (*b*) an auxiliary photoconductive layer, disposed on a light transmissive conductive layer on the surface of which is provided charge opposite to that on the main photoconductive layer, to face each other across a small distance, (2) simultaneously forming, by image exposure to the same original from the back of the auxiliary photoconductive layer, electrostatic latent images on both the layers where the product of relative sensitivity ratio and relative exposure ratio of the main photoconductive layer is 2 to 1000 times greater or less than the product of relative sensitivity ratio and relative exposure ratio of the auxiliary photoconductive layer, and (3) thereafter supplying a developer between the layers while still facing each other for developing the latent image on the main photoconductive layer, the developed image reproducing gradations in tone of the original due to the latent image on the auxiliary photoconductive layer.

6 Claims, 9 Drawing Figures

ELECTROPHOTOGRAPHIC PROCESS USING SEPARATE PHOTOCONDUCTIVE ELEMENTS

CROSS REFERENCE TO RELATED APPLICATIONS

This application is a continuation-in-part of U.S. Pat. Application Ser. No. 207,810 filed Dec. 14, 1971, now abandoned.

BACKGROUND OF THE INVENTION

1. Field of the Invention

The present invention relates to an electrophotographic process.

2. Description of the Prior Art

In prior methods for developing electrostatic latent images, it has been common to closely face a grounded conductive developing electrode closely toward the latent image, with the charged particles or toner being supplied between them to obtain an image of continuous tone.

In this instance, due to the electrostatic latent image, a vertical electric field is generated between the developing electrode and the latent image surface. Corresponding to the strength of the electric field or the quantity of charge comprising the latent image, the toner is attracted to the latent image surface to provide a continuous tone image.

In this prior art method, however, it has been difficult to obtain a toner image faithfully corresponding to the exposure because of the difficulty in obtaining on the photoconductive layer an electrostatic latent image which faithfully corresponds to the original image pattern and density.

FIG. 1 shows characteristic curves for electrophotographic images. In FIG. 1 the vertical axis represents the optical density of the electrophotographic image, and the horizontal axis represents the logarithm of the exposure amount. Curve *a* is a characteristic curve for a so-called soft image whose maximum density is low. Curbe *b* is a characteristic curve for a so-called heavy image having a narrow reproduction exposure region, although the maximum density is high. Curve *c* is a characteristic curve for a preferred image which has a wide reproduction exposure region and a high maximum density. In prior art electrophotographic methods, it is possible to obtain an image as shown in curves *a* and *b*, but it has been difficult to obtain a preferred image as shown in curve *c*.

SUMMARY OF THE INVENTION

The present invention provides an electrophotographic process to obtain an image with a wide reproduction exposure region and high maximum density which eliminates the drawbacks of the prior art. The invention is especially effective in reproducing an original image with soft tone and a large density spread, such as a radiographic image.

The novel electrophotographic process of the present invention is characterized in employing a developing electrode (hereafter called the auxilliary photoconductive element) comprising a photoconductive insulating layer which is light transmissive (hereafter call the auxilliary photoconductive layer) provided on a light transmissive conductive layer, said auxilliary photoconductive layer surface being charged and so positioned as to closely face a previously charged main electrophotographic sensitive layer (hereafter called the main photoconductive layer) while being exposed from the back of the auxilliary conductive element. Latent images are formed on the surfaces of the main photoconductive layer and the auxilliary photoconductive layer where the quantity of charge comprising the respective latent image is different. An electrophotographic developer is then supplied between the main photoconductive layer and the auxilliary photoconductive layer to develop the latent image on the surface of said main photoconductive layer. The developer which is introduced between the auxilliary photoconductive layer and the main photoconductive layer is highly attracted to the charged areas of the main photoconductive layer due to the attraction of one photoconductive layer and the repulsion of the other photoconductive layer. There is thus obtained a preferred image as shown in the curve *c* in FIG. 1.

DETAILED DESCRIPTION OF THE INVENTION

Figure 1:
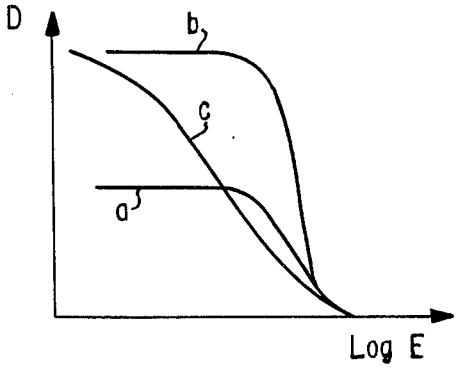
FIG. 1 is a graph of characteristic curves for prior art electrophotographic images and a preferred electrophotographic image.

A detailed description of the present invention will now be made with reference to the accompanying drawing where like reference numerals refer to like parts.

Figure 2:
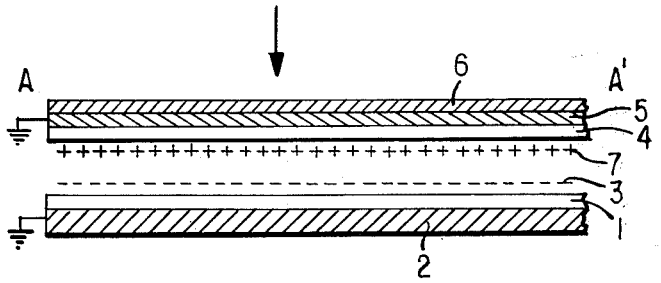
FIGS. 2 and 3 are an illustration of an electrophotographic process of the present invention.
Figure 3:
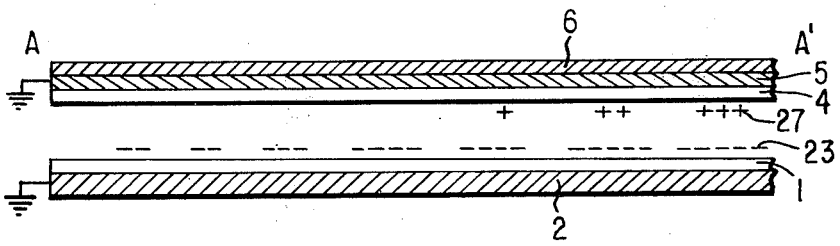

FIGS. 2 and 3 are illustrations of an electrophotographic process of the present invention. In FIG. 2, 1 is the main photoconductive layer with a grounded conductive support 2 at its back, on which the image is formed by the toner. 3 is the electric charge given, before exposure, to the surface of the main photoconductive layer 1 by any conventional means, such as a corona discharge, here with a negative polarity. 4 is the auxilliary photoconductive layer closely facing at a small and definite distance, the main photoconductive layer 1. Auxilliary photoconductive layer 4 is provided with light transmissive conductive layer 5 and light transmissive support 6. 7 is the electric charge given the surface of auxilliary photoconductive layer 4 by any conventional means, here having a positive polarity or a polarity opposite to that given the main photoconductive layer 1.

The main photoconductive layer 1 may have almost the same sensitivity as the auxilliary photoconductive layer 4, as will be brought out in more detail hereinafter. Layer 1 and support 2 may comprise a fine powdered ZnO dispersed in a resin such as polyacrylic ester, a silicon resin, polystyrene, and applied to a metal such as aluminum or a paper made suitably conductive.

The photoconductive material of layer 1 may also be titanium oxide, cadmium oxide, or an organic photoconductive material such as polyvinylcarbazole or any other photoconductive material. Also the conductive support 2 may also be a plastic film such as polyethylene terephthalate or cellulose triacetate, or a paper having a metal layer formed by vacuum plating, laminating or adhering. The auxiliary photoconductive layer 4 may comprise any photoconductive material such as polyvinyl carbazole sensitized with a dye or an electron accepting substance applied to NESA coated glass, for example. The typical total percent transmittance of auxiliary photoconductive layer 4 and light transmissive support layers 5 and 6 (or just layers 4 and 5 if layer 6 is not employed) may be 1.0 to 80% and preferably 1.0 to 50%. Percent transmittance is based on the incident radiation used in the exposing step where a percent transmittance of 1 – 50%, for example, means that the light which is transmitted through the auxiliary photoconductive element to main photoconductive layer 1 and used to discharge the surface charge on the photoconductive layers 1 and 4 is reduced to 1 – 50% of the incident light on the auxiliary photoconductive element.

The distance between the main photoconductive layer 1 and the auxiliary photoconductive layer 4 may be about 0.1 to about 5 mm. This distance may be maintained by a clamp, for example, positioned at the edges of the main photoconductive layer 1 and the auxiliary photoconductive layer 4, as they face each other. During exposure, a light transmissive insulating film may be inserted between them and during developing the light transmissive insulating film may be removed and developer supplied between layers 1 and 4 while a suitable thickness is maintained between them by spacers positioned at their ends.

Exposure is made from the back of the auxiliary photoconductive element. A photographic film having an image partially dark and bright may be used. Thus, the amount of exposure would vary. However, it is assumed that the exposure is reduced continuously and substantially linearly from A to A′, since the assumption makes it possible to better discuss the present invention. The result is that the charge given the surface of the main photoconductive layer 1 and the auxiliary photoconductive layer 4 may decay at a rate almost corresponding to the exposure as shown in FIG. 3, as will be brought out in more detail hereinafter, where 23 and 27 illustrate residual charges.

Referring further to FIG. 3, electrophotographic developer (the colored powder or toner with positive charge dispersed in an insulating liquid for example) is supplied, after exposure, to the space between the main photosensitive layer 1 and the auxiliary photosensitive layer 4. One such developer insulating liquid is Isopar H (Esso Standard Oil Company) which is an isoparaffinic based solvent. Carbon black toner and linseed oil as a charge control aid are carried in the Isopar H which is processed by ultrasonic dispersion. The toner is attracted by the residual negative charge 23 on the surface of the main photoconductive layer 1 and repelled by the residual positive charge 27 on the surface of the auxiliary photoconductive layer 4 and so the toner adheres to the surface of the main photoconductive layer 1 with negative charge 23. The residual positive charge 27 region faces the residual negative charge 23 region. The electric field at the residual negative charge 23 region is greater when positive charge 27 is present than when positive charge 27 is not present. Accordingly, when positive charge 27 is present, more toner adheres to the low exposure regions or the dark portions of the image. Thus the toner density of the dark portion is such as to make a large exposure range. Thus, it is possible to obtain a shadow detail image. Needless to say, an image with little edge effect is obtained because auxiliary photoconductive layer 4 acts as a developing electrode.

FIG. 3 illustrates an embodiment of the invention where the auxiliary photoconductive layer 4 is 2 to 100 times higher in sensitivity than the main photoconductive layer 1 and/or the auxiliary photoconductive element has a percent transmittance of 1 – 50%. Thus, there is obtainable an image with a large exposure region and a high maximum density.

In FIG. 3 a representation is shown of the charge distribution given after an exposure which substantially linearly decreases toward A′ from A. Since the auxiliary photosensitive layer 4 is 2 to 100 times higher in sensitivity, for example, than the main photoconductive layer 1, the positive charge 27 on the surface of the auxiliary photoconductive layer 4 is discharged almost to zero in the high exposure region from A to the center of layer 4 and a little positive charge 27 remains near A′ since this is a low exposure region. On the other hand, the negative charge 23 on the surface of the main photoconductive layer 1 increases towrd A′ from near A, becoming quite substantial at the halfway point.

Since the auxiliary photoconductive layer 4 is higher in sensitivity than layer 1, the electric charge thereon becomes almost zero near A, as this is a high exposure region, and the electrostatic charge varies corresponding to the exposure, the area near A′ being a low exposure region. The main photoconductive layer 1 is lower in sensitivity than the auxiliary photoconductive layer 4, or it is effectively lower in sensitivity due to the reduction in the amount of light reaching it through the auxiliary photoconductive element where the percent transmittance thereof is 1 – 50% for example.

As a consequence of the above, a reasonable exposure is given to the relatively high exposure regions and the electrostatic charge varies corresponding to the exposure. The electrostatic charge does not vary near A′ due to the very low exposure. In such a state, when the positive charge toner in the developer is supplied between the main photoconductive layer 1 and the auxiliary photoconductive layer 4, the toner adheres to the surface of the main photoconductive layer 1 as determined by the sum of the negative charge 23 and the positive charge 27. Hence, the quantity of the toner adhered, even in the region where the negative charge quantity is saturated, increases in relation to the increase of the positive charge 27 because the positive charge 27 barely exists near A where the quantity of toner adhered is determined by the negative charge 23, whereas it is determined by the sum of the positive charge 27 and the negative charge 23 near A′. A preferred image is thus obtained of large reproduction density and high maximum density.

Even when the sensitivity of the auxiliary photoconductive layer 4 is almost equal to that of the main photoconductive layer 1 and the percent transmittance of the auxiliary photoconductive element is 1 to 50%, the above mentioned results occur because the sensitivity of the main photoconductive layer 21 is effectively reduced because of the reduced amount of light reaching main photoconductive layer 21.

Figure 4:
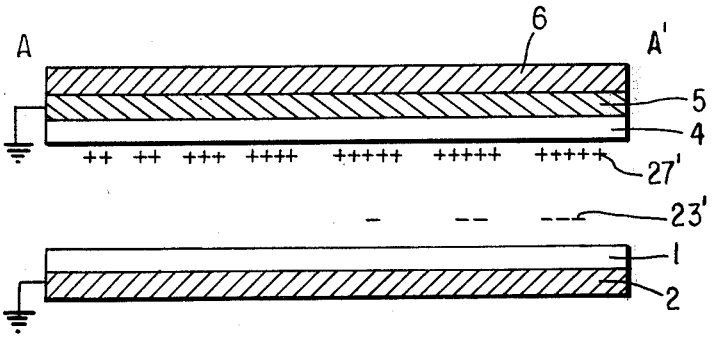
FIG. 4 is an illustration of a further embodiment of the present invention.

Referring to FIG. 4, the sensitivity of main photoconductive layer 1 may also be 2 to at least 100 times greater than that of the auxiliary photoconductive layer 4 to reverse the relative sensitivities of these layers. The amount of light reaching main photoconductive layer 1 decreases as it passes through the auxiliary photoconductive element and thus sensitivity of the main photoconductive layer is higher to compensate for this. After an exposure of the type described before for FIG. 3, the charge 23' on the main photoconductive layer is distributed according to the low exposure regions of the image, while the charge 27' on the auxiliary photoconductive layer is distributed corresponding to the high exposure regions of the image. Accordingly, the same preferred image of large reproduction density range is obtained by a similar developing. Thus, in FIG. 4, after exposure, the amount of negative charge 23' on the main layer is substantially reduced. Assuming a positive toner is introduced between the layers, the toner is attracted to the surface of main photoconductive layer 1 as determined by the sum of the negative charge 23' and the positive charge 27'.

In summary, the foregoing embodiments are characterized in that, the charge quantity which remains on layer 1 is different from that on layer 4, after exposure from the back, for example, of the auxiliary photoconductive element. The difference in discharging capability may be effected by (1) the layers having different sensitivities and/or (*b*) exposing the layers with a different amount of light by adjusting the percent transmittance of the auxiliary photoconductive layer. Further, over all sensitivities of layer 1 is at least 2 – 1000 times greater or less than that on layer 4, after exposure, and preferably 2 – 100 times greater or less than that on layer 4. The term "over all sensitivity" means the product of relative sensitivity ratio and an amount of exposure ratio between the main photoconductive layer 1 and the auxiliary photoconductive layer 4 for example, FIGS. 2 and 3.

The difference in the discharging ability of layers 1 and 4 is caused by the following factors (i) or (ii) the combination thereof:

i. Relative sensitivities of layers 1 and 4

Main photoconductive layer 1 may be 2 – 100 times lower or higher in sensitivity than auxiliary photoconductive layer 4.

ii. Amount of exposure applied to layers 1 and 4

The exposure amount applied to main photoconductive layer 1 is lower than that applied to auxiliary photoconductive layer 4. This is because the light which reaches main photoconductive layer is that which has been transmitted through the auxiliary photoconductive element, the percent transmittance of which is 1 – 80%.

Thus, over all sensitivity of layers 1 and 4 is different for each layer after exposure for factors (i) and/or (ii).

Figure 5:
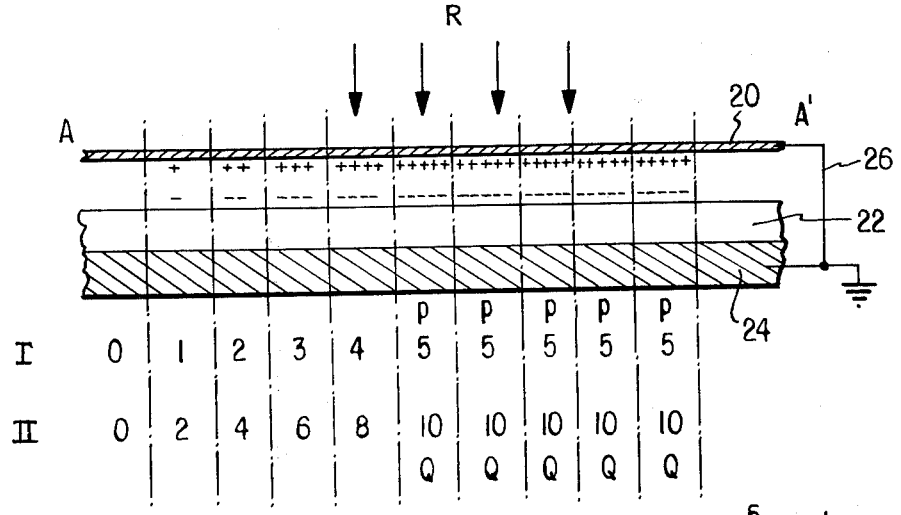
FIG. 5 (PRIOR ART)
FIG. 5 is an illustration of a prior art, normal developing electrophotographic process.
Figure 6:
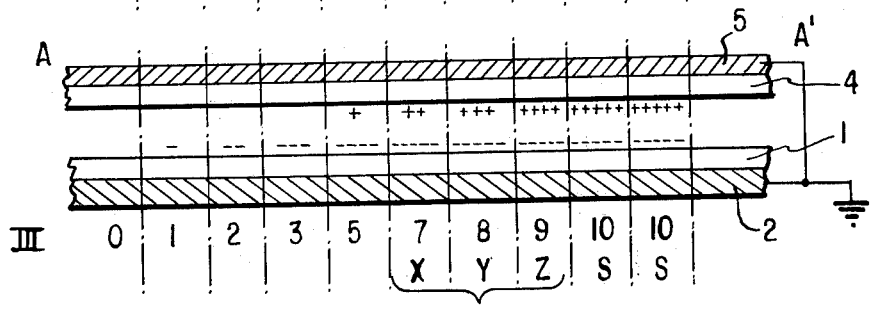
FIG. 6 is an illustration of a normal developing electrophotographic process which illustrates an important advantage of the present invention vis-a-vis FIG. 5.

The operation of the invention will now be further described with respect to the prior art. FIG. 5 illustrates the prior art and FIG. 6 the present invention. Exposure is made from the back of an electrically conductive electrode 20 (from the direction R) where electrode 20 is grounded via wire 26 to an electrically conductive base 24 for a photoconductive layer 22. The amount of exposure is continuously reduced from A to A'. In FIG. 5, the amount of charge, after exposure, on the electrode 20 is the same as that on photoconductive layer 22. In FIG. 6, the amount of charge, after exposure, on layer 4 is different from that on layer 1.

For convenience, the amount of charge is indicated by numerals 1 – 10 that is, numerals 1 – 10 correspond to charge quantity. The regions represented by numeral 5 in FIG. 5 of 10 in FIG. 6 are in a saturated state of charge quantity.

Case I shows the distribution of charge quantity without using electrode 20. Case II shows the distribution of charge quantity when using electrode 20. Both cases show that charge quantity becomes definite and saturated at the halfway point (at the regions represented by *p* and Q). Case III shows the distribution of charge quantity in the present invention. The distribution of cases II and III are determined by the sum of the negative and positive charge. As is apparent from FIG. 6, the sum of the charge quantity increases faithfully in response to the original tone, where the region represented by S is saturated in charging quantity. Note, in particular, regions X, Y and Z. In these regions, the varying tone of the original is faithfully reproduced. While, in FIG. 5 the charge quantity attains a saturated state at the region Q and thus the varying tone of the original is not faithfully reproduced.

Figure 7:
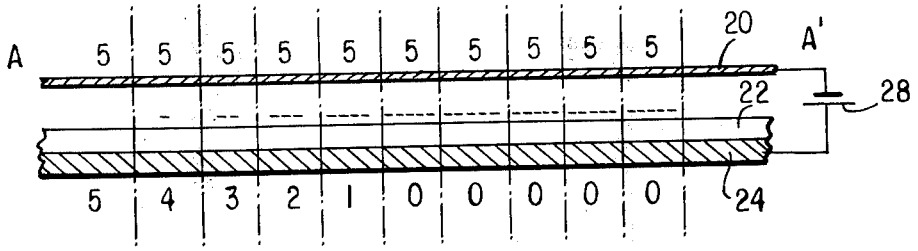
FIG. 7 (PRIOR ART)
FIG. 7 is an illustration of a prior art, reversal developing electrophotographic process.
Figure 8:
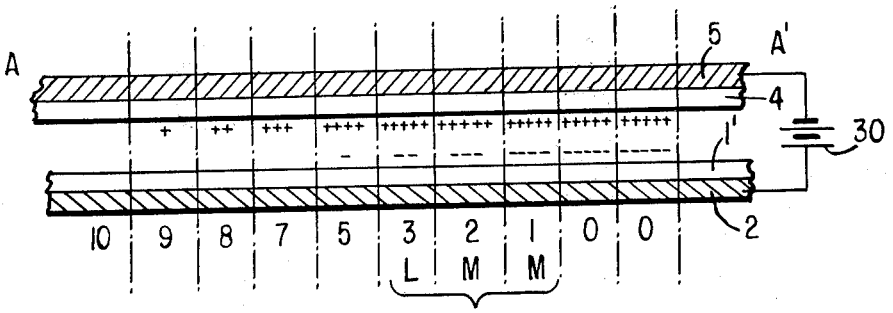
FIG. 8 is an illustration of a reversal developing electrophotographic process which illustrates an important advantage of the present invention vis-a-vis FIG. 7.

The operation described above can also be applied to reversal development. Thus, referring to FIG. 7, there is shown a prior art reversal development apparatus corresponding to FIG. 5 where electrode 20 is biased by a battery 28 with respect to base 24. FIG. 8 shows a reversal development apparatus in accordance with the invention corresponding to FIG. 6 where the electrode 5 is biased by a battery 30 with respect to base 2 and where the relative charge quantities on layers 1 and 4 may be adjusted as described hereinbefore with respect to FIGS. 1 – 4 and where negative toner is introduced between the layers 1 and 4. As is apparent from the numerals 1 – 10 of FIG. 8, the tone of the original can be faithfully reproduced. Note in particular the regions L, M and N. In these regions, the tone which is not reproduced in the prior art is reproduced.

The phenomena described above are also represented by the characteristic curves of FIG. 1. FIGS. 6 and 8 correspond to curve *c* of FIG. 1, curve *c* showing that density variation corresponds to the exposure amount.

In general, either normal or reversal development can be effected regardless of whether the charge quantity on layer 1 is greater than or less than that on layer 4. A basic requirement for reversal development is that a bias voltage should be applied between the respective conductive backing layers 2 and 5 of photoconductive layers 1 and 4. Further, the polarity of the bias voltage should be such that the conductive backing layer for auxiliary layer 4 is biased to the same polarity as that of the toner, which in turn, has the same polarity as the latent image on main layer 1. In particular, if the toner polarity is positive, for example, the conductive backing layer for auxiliary layer 4 should be biased positively with respect to the conductive backing layer for main layer 1 regardless of whether the total charge on layer 1 is greater or less than that on layer 4, assuming the polarity of the latent image on layer 1 is positive.

Figure 9:
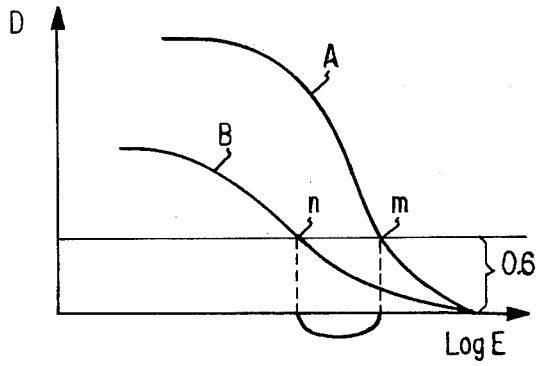
FIG. 9 is a graph of characteristic curves illustrating the determination of relative sensitivities of photoconductive layers.

The term "sensitivity" as used in connection with photoconductive layers 1 and 4 is employed in the specification and claims in the same sense that this term is conventionally employed in the electrophotographic arts. Thus, for example, referring to FIG. 9, the ratio of the sensitivities of layers 1 and 4 can be determined as follows where the vertical axis of FIG. 9 represents optical density on the surface of a photoconductive layer and the horizontal axis represents the logarithm of the exposure amount. The curves A and B are characteristic curves of two photoconductve layers such as layers 1 and 4. One of ordinary skill in this art can readily determine the point at which the optical density is higher by 0.6 than the minimum value of the optical density. This minimum value will be approximately the same for both layers. Points *m* and *n* of curves A and B respectively correspond to the points where the is 0.6 greater than the minimum value of optical density. The difference in the values of the exposure amount from point *m* to point *n* represents the ratio of the sensitivities of the two layers. That is, the ratio of the exposure amount at point *m* to the exposure amount at point *n* is the ratio of the sensitivities of the two layers. In the above it should be noted that the sensitivities of the layers are determined using at least approximately the same spectral distribution for each layer. For example, white light as above can be used in the image exposure step of the present invention.

The following examples of the invention are now given with no intent to be limited thereby.

EXAMPLE 1

An organic photoconductive material comprising polyvinylcarbazole sensitized with chloranil and tetracyanoquinodimethane was applied to the surface of stannic oxide coated glass plate, i.e. a so called NESA glass plate, at a dry thickness of 10 $\mu$ to form a transparent or auxiliary photoconductive layer thereon, thus preparing a transparent or auxiliary photoconductive element sheet, the light percent transmittance of which was 70%. While a main photoconductive sheet was prepared by dispersing zinc oxide in an alkyd resin and applying the dispersion to an aluminum plate at a dry thickness of 20 $\mu$ to form a main photoconductive layer thereon. The sensitivity of the main photoconductive layer was approximately one-tenth that of the transparent photoconductive layer. By means of corona discharge treatment, positive and negative electric charges were uniformly given the whole surface of the transparent photoconductive layer and the main photoconductive layer, respectively. The potential of the electric charges was 500 V in both cases. Thereafter, the two photoconductive layers were brought into face-to-face relationship, each of their conductive supporting layers was grounded and a polyvinyl chloride resin sheet 0.3 mm thick was inserted between peripheral portions of the two photoconductive layers to define a given small interspace between them. A photographic film having an image obtained by X-ray photographing a part of the human body was then placed as an original on the back of the transparent or auxiliary photoconductive sheet or element, i.e. on the glass of the NESA coated glass plate, and exposure was effected at 1,000 lux for 5 seconds using a tungsten lamp to thereby obtain the charge configurations shown in FIG. 3. The above-described interspace defined between the two photoconductive layers was then filled with a liquid developer and these conditions maintained for approximately 15 seconds, after which the developer was replaced with a fresh liquid developer, this condition also being maintained for approximately 15 seconds. The above replacement of the liquid developer was repeated four times to complete the developing process. As the liquid developer in this Example, there was employed one prepared by dispersing carbon black and linseed oil in an isoparaffin based solvent Isopar H (Trade name: Esso Standard Co.) by ultrasonic dispersion, with the electric charge of the toner being positive. The toner image thus obtained on the surface of the main photoconductive layer exhibited a satisfactory tone faithfully corresponding to the original high light and shadow pattern, i.e. the toner image had a wide reproduction density with a high maximum density.

EXAMPLE 2

A mixture of poly-N-vinyl carbazole and 4-nitropolystyrene as a transparent or auxiliary photoconductive layer was applied to a polyethylene terephthalate film support, with its surface made conductive with potassium polyvinyl benzenesulfonate, at a dry thickness of 5 $\mu$ to prepare a transparent or auxiliary photoconductive element or sheet, the light percent transmittance of which was 70%. A main photoconductive sheet was prepared by dispersing in an alkyd resin zinc oxide sensitized with Rose Bengale and applying the dispersion to a paper support, with its surface made conductive in the same manner as the transparent photoconductive element, at a dry thickness of 20 $\mu$, to thereby form a main photoconductive layer thereon. The sensitivity of the main photoconductive layer and that of the auxiliary photoconductive layer was almost equal. In the manner described in Example 1, −500 V of negative electric charge and +500 V of positive electric charge were imparted uniformly to the entire surfaces of the main photoconductive layer and the auxiliary photoconductive layer, respectively. Subsequently thereto, corresponding edges of the auxiliary and main photoconductive sheets were fixed with respect to one another, a gray filter having an optical transparency of 1.0 and a light percent transmittance of 10% was interposed between the two sheets, the surfaces of the main and auxiliary photoconductive layers were each placed in face-to-face relationship with respect to the filter, and the respective conductive layers on the back of the main and transparent photoconductive layers were grounded. The combined percent transmittance of the auxiliary photoconductive sheet and gray filter was 7%. The same original as in Example 1 was laid on the support of the transparent photoconductive sheet, followed by exposure at 1,000 lux for 2 seconds using a tungsten lamp to obtain the charge configuration shown in FIG. 3. After that, the gray filter inserted between the main and transparent photoconductive layers was removed and the sheets dipped in the same liquid developer as in Example 1. At this point, free edges of both the main and transparent sheets were sufficiently open for the liquid developer to pass into the interspace between the two sheets, after which the free edges were closed to expel excess developer, this condition being maintained for 10 seconds where the main and auxiliary photoconductive layer were interspaced via a liquid developer film of approximately uniform, extreme narrowness. This developing procedure was repeated six times to complete the developing process. The toner image thus obtained on the surface of the main photoconductive layer was a preferred one as in Example 1.

EXAMPLE 3

An experiment was conducted in which the sensitivity of layer 1 was 10 times higher than that of layer 4.

The procedures of Example 1 were repeated except that a mixture of 8 g. of polyvinyl carbazole and 2 g. of trinitrofluorescein was used as a coating material for the auxiliary photoconductive layer and the dispersion of 10 g. of zinc oxide and 0.5 mg. of Rose Bengal in alkyd resin was coated on the support in a dry thickness of 10 $\mu$to form a main photoconductive layer. The sensitivity of the main photoconductive layer was 10 times that of the auxiliary photoconductive layer. The percent transmittance of the auxiliary element was 60%. The charge configuration of the experiment was that of FIG. 4.

The thus obtained toner image on the main photoconductive layer had satisfactory tone faithfully corresponding to the original highlight and shadow pattern, i.e., the toner image had a wide reproduction density with a high maximum density.

EXAMPLE 4

An experiment was conducted in which the sensitivity of layer 1 was 100 times higher than that of layer 4.

The procedures of Example 3 were repeated except that 5 mg. of Rose Bengale was used.

The ratio of the sensitivity of the main photoconductive layer to the auxiliary photoconductive layer was 100.

The toner image thus obtained on the main photoconductive layer had a wide reproduction density with a high maximum density. The charge configuration of the experiment was that of FIG. 4.

EXAMPLES 5 – 7

Experiments were conducted using auxiliary photoconductive elements having different percent transmittances.

The procedures of Example 3 were repeated except for using the following auxiliary photoconductive layers.

TABLE I

| Example No. | Auxiliary Photoconductive layer | Percent Transmittance of Auxiliary Element |
|---|---|---|
| | Poly-N-vinylcarbazole:Trinitrofluorescein | |
| 5. | 85 : 15 | about 70% |
| 6. | 75 : 25 | about 50% |
| 7. | 75 : 25* | about 20% |

*In Example 7, a filter of optical transparency 0.6 was interposed between layer 1 and layer 4. The filter was removed after exposure.

The toner images thus obtained had wide reproduction densities with high maximum densities.

EXAMPLE 8

An experiment was conducted in which the sensitivity of the auxiliary photoconductive layer was 100 times higher than that of the main photoconductive layer.

The procedures of Example 3 were repeated except that poly-N-vinylcarbazole was coated in a dry thickness of 10 $\mu$ on a support having a selenium vacuum evaporated film thereon to form an auxiliary photoconductive element. A dispersion of zinc oxide in alkyd resin was coated in a dry thickness of 10 $\mu$ on an aluminum plate to form a main photoconductive layer. The ratio of the sensitivity of auxiliary photoconductive layer to that of main photoconductive layer was 100 by exposure to a tungsten lamp. The toner image thus obtained had a wide reproduction density with high maximum density.

EXAMPLE 9

An experiment was conducted to illustrate reversal development. A mixture of 8 g. of poly-N-vinylcarbazole and 2 g. of trinitrofluorescein was coated on the surface of a glass plate having a film of stannic oxide thereon (i.e. NESA glass) in a dry thickness 10 $\mu$ to form an auxiliary photoconductive element. A dispersion of 10 g. of zinc oxide and Rose Bengale in alkyd resin was applied on an aluminum plate at 10 $\mu$ dried thickness to form a main photoconductive element. The sensitivity of the main photoconductive layer was ten times that of the auxiliary photoconductive layer.

By means of a corona discharge treatment, positive and negative charge were applied to the entire surfaces of the auxiliary photoconductive layer and the main photoconductive layer, respectively. The potential of electric charge was 500 V in both cases. Thereafter these two photoconductive layers were brought into face-to-face relationship with the conductive supporting layers at their back each grounded and a polyvinyl chloride resin sheet 0.3 mm thick inserted between peripheral portions of the two photoconductive layers to define a small interspace between them. A photographic film having an image obtained by X-ray photographing a part of the human body was then placed as the original on the back of the auxiliary photoconductive element and exposure effected at 1,000 lux for 5 seconds using a tungsten lamp.

Thereafter, direct current potential was applied between the conductive layer of the auxiliary element and that of the main photoconductive element with −1000 V on the conductive layer of the auxiliary element. The above-described interspace was filled with a liquid developer and the above conditions maintained for approximately 15 seconds, after which the developer was replaced with a fresh liquid developer. Again the above conditions were maintained for approximately another 15 seconds. Replacement of the liquid developer, as described above, was repeated four times to complete the developing process. The liquid developer in the example was prepared by dispersing carbon black and ethylcellulose in an isoparaffin based solvent Isoper H (see Example 1) by ultrasonic dispersion where the electric charge of the toner was negative.

The toner image thus obtained was a reversal one and exhibited satisfactory tone faithfully corresponding to the original highlight and shadow pattern, i.e. the toner image had a wide reproduction density and a high maximum density.

Numerous modifications of the invention will become apparent to one of ordinary skill in the art upon reading the foregoing disclosure. During such a reading it will be evident that this invention provides a unique electrophotographic process for accomplishing the objects and advantages herein stated.

What is claimed is:

1. An electrographic process comprising (1) arranging (*a*) a main photoconductive layer disposed on a conductive base, on the surface of which a charge is uniformly provided, and (*b*) an auxiliary photoconductive layer, disposed on a light transmissive conductive layer, the total percent transmittance of the auxiliary photoconductive layer and the light transmissive conductive layer being 1–80%, on the surface of which auxiliary photoconductive layer is provided uniform charge opposite to that on said main photoconductive layer, to face each other across a small distance of about 0.1 to about 5 mm, (2) simultaneously forming, by image exposure to the same original from the back of said auxiliary photoconductive layer, electrostatic latent images on both said layers where the product of relative sensitivity ratio and amount of exposure ratio of said main photoconductive layer is 2 to 1000 times greater or less than the product of relative sensitivity ratio and amount of exposure ratio of said auxiliary photoconductive layer, and (3) thereafter supplying a developer between said layers while still facing each other for developing the latent image on said main photoconductive layer, the developed image reproducing gradations in tone of the original due to the latent image on said auxiliary photoconductive layer.

2. A process as in claim 1 where the polarity of said developer is opposite to that of the charge on the main photoconductive layer to thereby effect normal development of the electrostatic latent image on said main photoconductive layer.

3. A process as in claim 1 where the polarity of said developer is the same as that of the charge on the main photoconductive layer and said light transmissive conductive layer is electrically biased with respect to the conductive base for the main photoconductive layer so that the polarity of the voltage on the light transmissive conductive layer is the same as that of the developer to thereby effect reversal development of the electrostatic latent image on said main photoconductive layer.

4. A process as in claim 1 where the product of relative sensitivity ratio and amount of exposure ratio of said main photoconductive layer is 2 to 100 times greater or less than the product of relative sensitivity ratio and amount of exposure ratio of said auxiliary photoconductive layer.

5. A process as in claim 1 where the sensitivity of said main photoconductive layer is 2 to 100 times greater or less than that of said auxiliary photoconductive layer.

6. A process as in claim 1 where said total percent transmittance is 1 – 50%.

* * * * *